US008853986B2

(12) United States Patent
Wiltsch

(10) Patent No.: US 8,853,986 B2
(45) Date of Patent: Oct. 7, 2014

(54) METHOD AND DEVICE FOR DIAGNOSING A FAN

(75) Inventor: Peter Wiltsch, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 646 days.

(21) Appl. No.: 13/026,952

(22) Filed: Feb. 14, 2011

(65) Prior Publication Data

US 2011/0199036 A1 Aug. 18, 2011

(30) Foreign Application Priority Data

Feb. 18, 2010 (DE) ..... 10 2010 002 078

(51) Int. Cl.

| | |
|---|---|
| ***G01R 31/02*** | (2006.01) |
| ***H02H 3/04*** | (2006.01) |
| ***H02H 7/08*** | (2006.01) |
| ***F01P 11/14*** | (2006.01) |

(52) U.S. Cl.

CPC ..... *F01P 11/14* (2013.01)
USPC ..... 318/490; 318/471; 318/139; 318/400.22; 361/23; 361/25

(58) Field of Classification Search

USPC ..... 318/471, 139, 720, 721, 723, 798, 799, 318/400.01, 400.07, 400.1, 400.22, 400.42, 318/708, 782, 783; 361/23–25
See application file for complete search history.

(56) References Cited

U.S. PATENT DOCUMENTS

| | | | | |
|---|---|---|---|---|
| 6,023,138 | A * | 2/2000 | Fried et al. | 318/434 |
| 6,344,636 | B1 * | 2/2002 | Kim | 219/702 |
| 6,483,423 | B1 * | 11/2002 | Han | 340/3.1 |
| 6,512,346 | B2 * | 1/2003 | Yoshimura | 318/599 |
| 6,650,075 | B2 * | 11/2003 | Otsuka et al. | 318/268 |
| 6,747,432 | B2 * | 6/2004 | Yoshimura | 318/599 |
| 7,705,554 | B2 * | 4/2010 | Knab et al. | 318/650 |
| 7,755,311 | B2 * | 7/2010 | Morishita | 318/400.21 |
| 7,795,898 | B2 * | 9/2010 | Masuya et al. | 324/765.01 |
| 2001/0030524 | A1 * | 10/2001 | Yoshimura | 318/599 |
| 2002/0075615 | A1 * | 6/2002 | Miermans | 361/78 |
| 2005/0118029 | A1 * | 6/2005 | Kim | 417/18 |
| 2006/0176186 | A1 * | 8/2006 | Larson et al. | 340/635 |
| 2006/0199521 | A1 * | 9/2006 | Masuya et al. | 454/239 |
| 2008/0007297 | A1 * | 1/2008 | Morishita | 326/72 |
| 2010/0094593 | A1 * | 4/2010 | Reddy et al. | 702/183 |

FOREIGN PATENT DOCUMENTS

| | | |
|---|---|---|
| CN | 1206895 | 2/1999 |
| CN | 1307388 | 8/2001 |
| CN | 1404707 | 3/2003 |
| CN | 1648680 | 8/2005 |
| JP | 8-247562 | 9/1996 |

* cited by examiner

*Primary Examiner* — Erick Glass
(74) *Attorney, Agent, or Firm* — Kenyon & Kenyon LLP

(57) ABSTRACT

Method for diagnosing a fan, in particular in a cooling circuit of an internal combustion engine, a current driving the fan being ascertained. The fan is triggered by a defined trigger signal, and depending on the ascertained current, a diagnosis of whether the fan is defective is performed.

17 Claims, 4 Drawing Sheets

METHOD AND DEVICE FOR DIAGNOSING A FAN

CROSS-REFERENCE TO RELATED APPLICATIONS

The present application claims priority to Application No. 10 2010 002 078.8, filed in the Federal Republic of Germany on Feb. 18, 2010, which is expressly incorporated herein in its entirety by reference thereto.

FIELD OF THE INVENTION

The present invention relates to a method for diagnosing a fan. The subject matter of the present invention is also a device for diagnosing a fan. The subject matter of the present invention is also a computer program, an electrical memory medium, and a control and regulating device.

BACKGROUND INFORMATION

To comply with OBDII legislation in the United States, all exhaust-relevant components of a motor vehicle must be diagnosed by a device, a so-called control unit, which regulates or controls an internal combustion engine.

The engine fan must also be diagnosed if it is used for diagnosing an exhaust-relevant component of a motor vehicle. Certain methods of diagnosing fans are conventional. In many approaches, the cooling power of the fan is evaluated by a temperature sensor. Other methods use rotational speed sensors to monitor the rotational motion of the fan.

These additional sensors require additional lines in the cable harness of the vehicle. Furthermore, these additional sensors must themselves be diagnosed for compliance with OBDII legislation.

SUMMARY

The method according to example embodiments of the present invention, in which the fan is triggered using a defined trigger signal and it is diagnosed as a function of an ascertained current whether the fan is defective, has the advantage over conventional systems in that the fan may be diagnosed without the use of additional sensors.

In example embodiments, the fan is triggered with the maximum possible trigger signal. This has the advantage that the method is particularly robust.

If a defect in the fan is diagnosed when a value derived from the ascertained current is not below a predefinable current level, this has the advantage that sluggish fans may be identified reliably in particular.

If a defect in the fan is diagnosed when a value derived from the ascertained current is not below a predefinable current level up to a predefinable point in time, the method may be terminated after a defined point in time and is thus particularly robust.

The method is particularly simple if the ascertained current is itself used as the value derived from the ascertained current. If the smoothed ascertained current is used as the value derived from the ascertained current, then the method is robust in particular with respect to signals having a high noise level.

If a defect is diagnosed as a function of a ripple in the ascertained current, this has the particular advantage that it allows fans having a damaged rotor to be identified.

If a defect is diagnosed when the ripple exceeds a predefinable ripple level, then the method for diagnosing defects may be implemented in a particularly simple manner. If a defect is diagnosed when the ripple exceeds the predefinable ripple level within a predefinable period of time, the diagnostic method may be terminated after a defined period of time. It is thus particularly robust.

If, after the current signal detected has dropped below a second predefinable current level, a defect is diagnosed in the method when the ripple exceeds the predefinable ripple level, the calculation of the ripple may be made robust using particularly simple arrangements. If the ripple is characterized by the amplitude of oscillation of the current signal detected, then it is particularly simple to ascertain the ripple.

Example embodiments of the present invention are explained in greater detail below with reference to the accompanying drawings.

DETAILED DESCRIPTION

Figure 1:
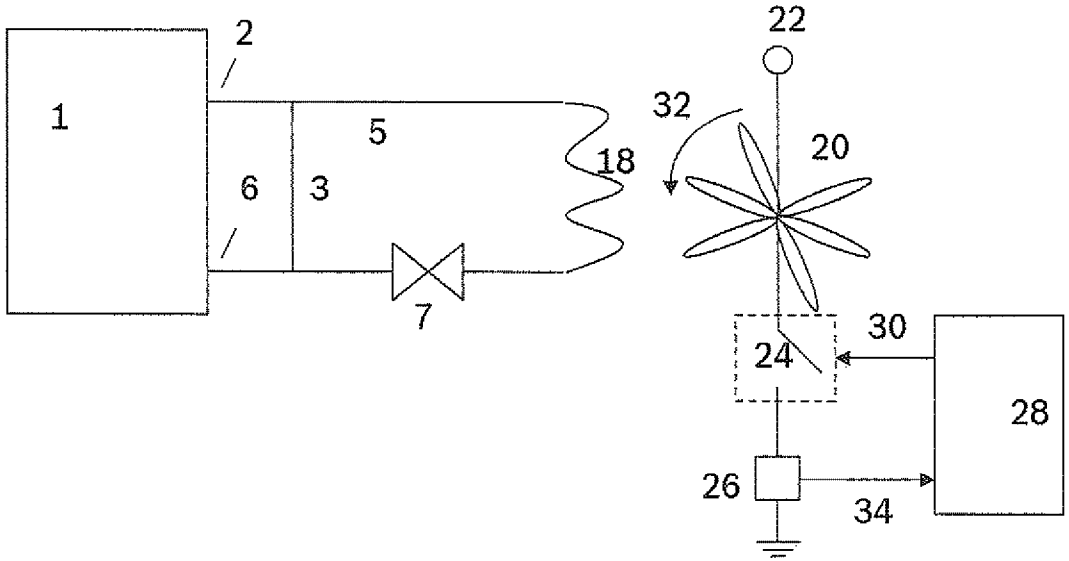
FIG. 1 shows a schematic diagram of a cooling circuit having a fan.

FIG. 1 shows internal combustion engine 1, a first coolant line 3, a second coolant line 5, and a thermostat 7. First coolant line 3 together with a first connection point 2 and a second connection point 6 forms a first coolant circuit for cooling internal combustion engine 1. Second coolant line 5 together with first connection point 2 and second connection point 6, a cooler 18 and thermostat 7 forms a second coolant circuit. The first coolant circuit and the second coolant circuit are filled with a coolant, for example, water. Thermostat 7 switches between the first coolant circuit and the second coolant circuit. At low temperatures, thermostat 7 is closed and the coolant flows through the first coolant circuit and through internal combustion engine 1. At high temperatures, thermostat 7 is opened and coolant flows through second coolant circuit 5 and through internal combustion engine 1.

FIG. 1 also shows a fan 20, a voltage source 22, switching device 24, current detection device 26, and a diagnostic device 28. Voltage source 22, fan 20, switching device 24, and current detection device 26 are connected electrically in series. Diagnostic device 28 transmits a trigger signal 30 to switching device 24. For example, the trigger signal assumes signal values "on" and "off." However, trigger signals 30 allowing additional intermediate values between "on" and "off" are also possible. If trigger signal 30 has the value "on," the fan begins a rotational movement 32. If trigger signal 30 assumes the value "off," fan 20 comes to a standstill. If fan 20 executes a rotational movement 32, it consumes current, which is detected using current detection device 26.

Current detection device 26 relays detected current signal 34 to diagnostic device 28. Diagnostic device 28 then controls switching device 24 using a defined trigger signal 30 in the method and analyzes detected current signal 34. Depending on ascertained current signal 34, a defective engine fan is diagnosed.

Figure 2:
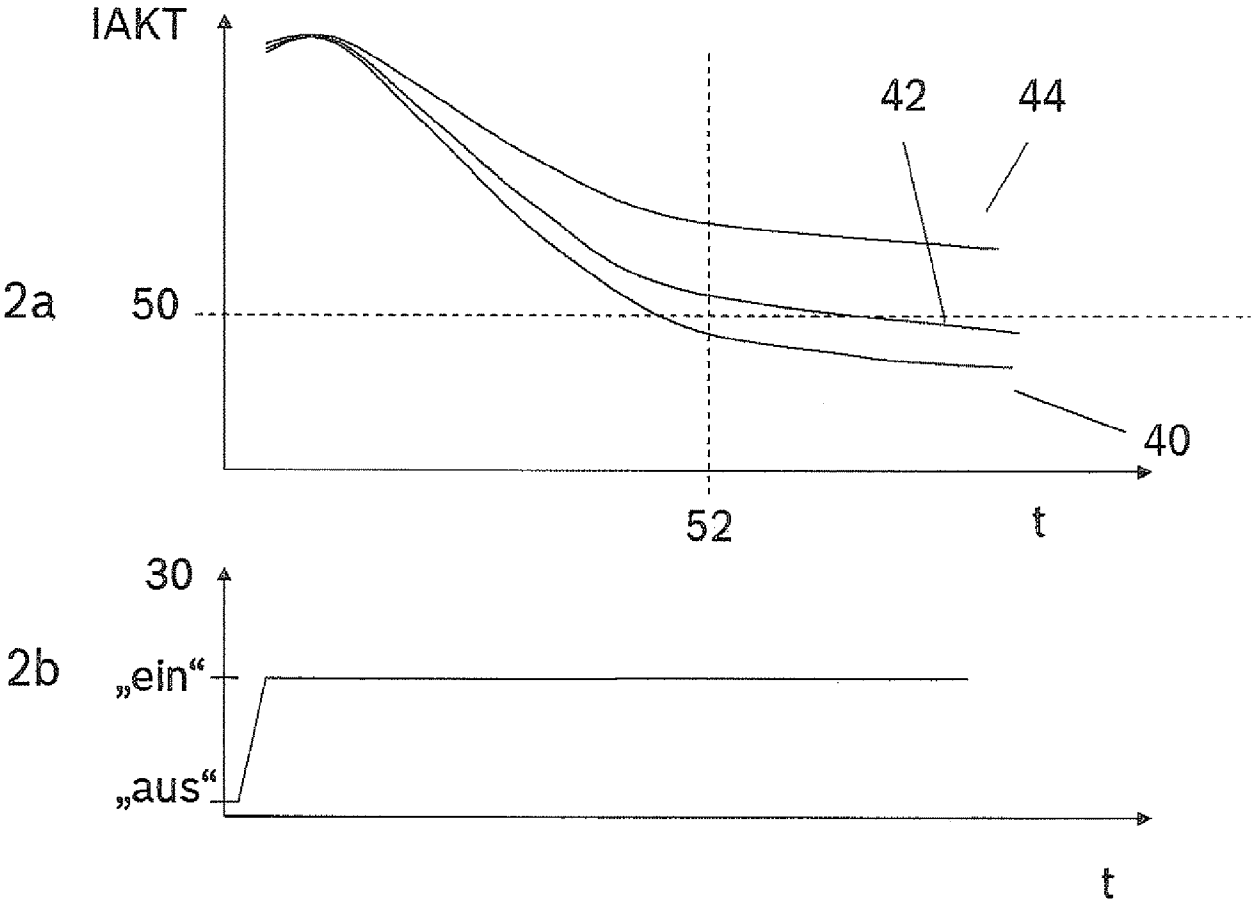
FIG. 2 shows an illustration of the diagnostic method with a sluggish fan.

FIG. 2 illustrates the diagnostic method for the case of a sluggish fan. FIG. 2*a* shows time t on the abscissa, a value derived from ascertained current 34 and labeled using reference notation IAKT being shown on the ordinate. In the exemplary embodiment, this derived value IAKT is a smoothed current, for example, a sliding average of ascertained current 34, which, as known, has a certain noise level. However, if the noise level of ascertained current 34 is low enough to perform the method described below in a robust manner, then it is also possible for derived value IAKT to be the value of the current itself.

The curve of the ascertained current of a defect-free fan carries reference numeral 40, while reference numerals 42 and 44 represent two curves of sluggish fans. A predefinable current level 50 is also shown; smoothed ascertained current IAKT must be below this current level until a predefinable point in time 52 in order for diagnostic device 28 to diagnose a non-defective engine fan. However, if the current level does not fall below predefinable current level 50 up to predefinable point in time 52, diagnostic device 28 will diagnose a defect.

Predefinable current level 50 is advantageously selected as a function of the characteristic of fan 20, so that the curve of smoothed ascertained current IAKT of a defective fan 20 is reliably below predefinable current level 50. Furthermore, predefinable current level 50 is advantageously selected as a function of the characteristic of fan 20, so that the curve of smoothed ascertained current IAKT of a defective fan 20 reliably does not fall below predefinable current level 50 at all or not until predefinable point in time 52.

Predefinable point in time 52 is advantageously selected as a function of the characteristic of fan 20 and the exemplary scattering of fan 20, so that in combination with the choice of predefinable current level 50, it causes the differentiation of defective and defect-free fans 20 to be as robust as possible despite the exemplary scattering.

FIG. 2*b* shows the curve of trigger signal 30 over time. Time t is plotted on the abscissa, trigger signal 30 on the ordinate. In the exemplary embodiment shown here, the value of trigger signal 30 jumps from a minimum possible value, e.g., 0 at the start of the diagnostic method, to a maximum possible value. However, it is also possible in general for the trigger signal to jump from a first value to a second value. The first value must then be selected so that fan 20 does not execute a rotational movement or comes to a standstill. The second value must then be selected so that fan 20 executes a rotational movement 32. If trigger signal 30 is digital, it jumps from "off" to "on," for example. Next the trigger signal in the exemplary embodiment is kept constant for the course of the diagnostic method.

After the trigger signal has jumped to "on," the ascertained current through the fan motor corresponds to a maximum startup current, which, with an increase in the rotational speed of rotational movement 32, stabilizes at a minimal level at the maximal rotational speed. Time curves 40, 42 and 44 shown in FIG. 2*a* for ascertained current 34 illustrate this characteristic behavior.

Curve 40 corresponding to a defect-free fan has fallen below predefinable current level 50 at predefinable point in time 52, as shown here. Diagnostic device 28 therefore diagnoses a defect-free fan. Current curve 44 corresponding to a sluggish fan does not drop to predefinable current level 50. Diagnostic device 28 therefore diagnoses a defective sluggish engine fan. Current curve 42, which also corresponds to a sluggish fan 42, falls below predefinable current level 50 but does not do so by predefinable point in time 52. Diagnostic device 28 therefore decides that this is a defective sluggish engine fan.

Figure 3:
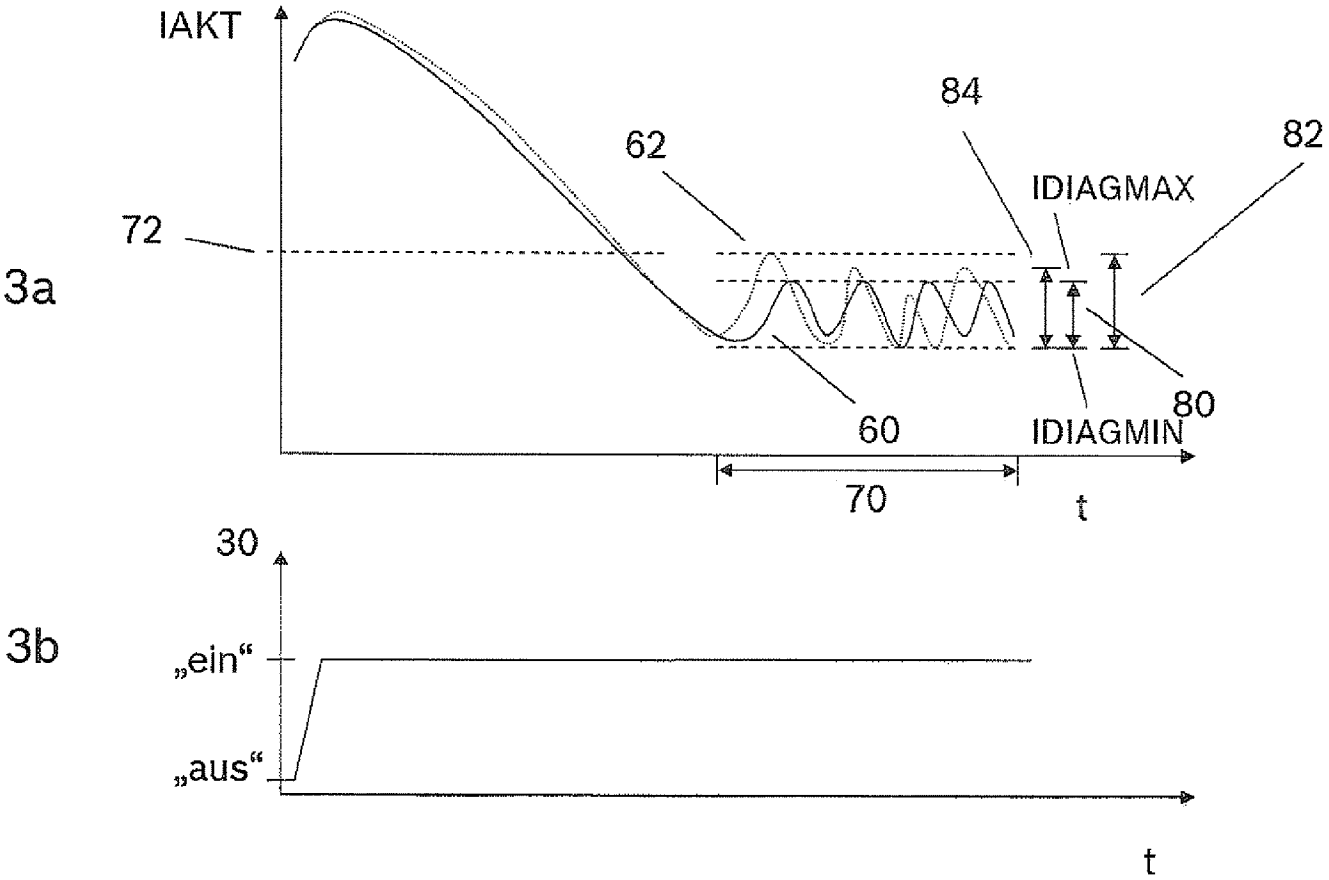
FIG. 3 shows an illustration of the diagnostic method with a damaged rotor of the fan.

FIG. 3 illustrates the diagnostic method using the example of a damaged rotor of the engine fan. If the fan is smooth-running, i.e., defect-free according to the diagnostic procedure illustrated in FIG. 2*a*, but the rotor is nevertheless severely damaged, so that its cooling performance would be greatly reduced, then the ascertained current will have an increased ripple because of irregular rotational movement 32 of fan 20. In the exemplary embodiment, the ripple of the ascertained current is characterized by the oscillation amplitude of the ascertained current. FIG. 3*a* shows curves of detected current signal 34 over time for a defect-free fan and for a fan having a damaged rotor. Time t is plotted on the abscissa, smoothed ascertained current 34 labeled using reference notation IAKT being shown on the ordinate. The current curve of the defect-free fan is labeled using reference numeral 60, while the current curve of the fan having the damaged rotor is labeled using reference numeral 62. FIG. 3*b* corresponds to FIG. 2*b* and shows the curve of trigger signal 30 over time t. Current curves 60 and 62 here show a declining trend at first, like current curves 40, 42 and 44 shown in FIG. 2*a*; after a certain period of time, they show an oscillation behavior about a relatively constant value. This oscillation behavior may be evaluated by diagnostic unit 28, for example, during a predefinable period of time 70 or after the value of the ascertained current has dropped below a second predefinable current level 72.

In general, second predefinable current level 72 and predefinable period of time 70 are advantageously selected so that it is possible to reliably ascertain the ripple in the ascertained current in predefinable period of time 70 or after second predefinable current level 72 if fan 20 is defect-free and the trigger signal has the curve described described herein.

In the exemplary embodiment, second predefinable current level 72 and predefinable period of time 70 are advantageously selected, so that it is possible to reliably ascertain the oscillation amplitude of the ascertained current signal as the difference between the maximum and minimum values of the ascertained current in predefinable period of time 70 or after second predefinable current level 72 when fan 20 is defect-free and trigger signal 30 has the curve over time described herein.

In the exemplary embodiment it is illustrated below that the oscillation amplitude of the smoothed ascertained current curve is analyzed during predefinable period of time 70. Oscillation amplitude IDIAGAMP of ascertained current curve 60, which is defined in the exemplary embodiment as the difference between the maximum of current curve 60 IDIAGMAX and the minimum of current curve 60 IDIAGMIN, characterizes a ripple in the smoothed ascertained current curve in the exemplary embodiment. This ripple is labeled using reference numeral 80. A similarly defined second ripple in the smoothed ascertained current curve 62 is labeled as 82. As explained here, second ripple 82, which corresponds to a defective rotor, is much greater than ripple 80, which corresponds to a defective fan. This also shows a predefinable ripple value 84. If the ripple of the smoothed ascertained current level is smaller than this predefinable ripple value 84, then diagnostic unit 28 decides that the fan is defect-free. However, if the ripple is greater than this predefinable ripple value 84, then diagnostic unit 28 decides that the fan is defective and the rotor is damaged. In the exemplary embodiment, ripple 80 is smaller than predefinable ripple value 84 for the case of a defect-free fan illustrated here, so a defect-free fan is diagnosed. However, second ripple 82 in the illustrated case of the fan having a defective rotor is greater than predefinable ripple value 84, so a fan having a defective rotor is diagnosed.

Predefinable ripple value 84 is advantageously selected, so that ripple 80 of a defective fan is smaller than predefinable ripple value 84, taking into account the exemplary fluctuations in fan 20, and second ripple 82 of a defective fan is greater than predefinable ripple value 84.

Example embodiments, in which the diagnostic method for detection of a sluggish fan 20 is combined with the diagnostic method for detection of a fan 20 having a defective rotor, are advantageous.

Figure 4:
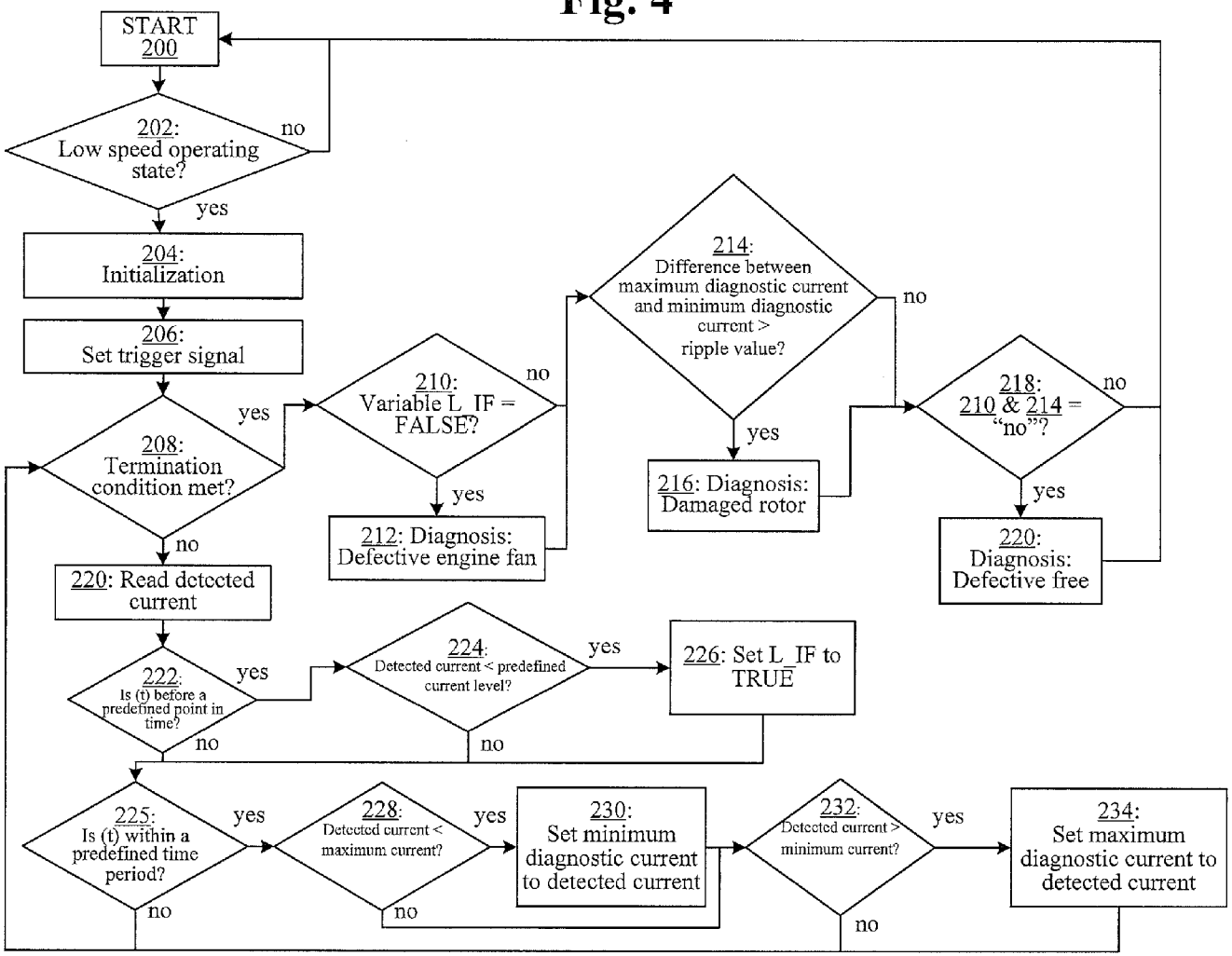
FIG. 4 schematically shows the sequence of the diagnostic method.

FIG. 4 contains a flow chart for performing such a diagnostic method as an example.

Steps 200 and 202 check whether the diagnostic method is starting, step 204 includes initializations, and trigger signal 30 is switched in step 206. Step 208 checks whether the diagnostic method is concluded; detected current 34 is read out in step 220; steps 222, 224 and 226 check whether the value of the smoothed current curve 60 falls below predefinable current level 50 before predefinable point in time 52, and maximum IDIAGMAX and minimum IDIAGMIN of the smoothed current curve 60 are ascertained in steps 225, 228, 230, 232 and 234. Steps 210, 214 and 218 check which defects have been diagnosed, whereupon corresponding measures are taken in steps 212, 216 and 220.

Step 200 marks the start of the diagnostic method. Step 202 then follows. Step 202 checks, for example, whether an operating state having a low speed or vehicle standstill has been reached so that a low airflow may be expected. If this is the case, the sequence continues with step 204. If this is not the case, the sequence jumps back to step 200.

In step 204, variables are read out of a memory of diagnostic unit 28. In the exemplary embodiment, variables N_IMAX, representing a current level (for example, 10 A), which is definitely not exceeded by ascertained current 34 or smoothed current IAKT, N_IMIN representing a current level (for example, 0 A) below which ascertained current 34 or smoothed current IAKT definitely does not fall, predefinable current level 50, predefinable point in time 52, and predefinable period of time 70. Instead of predefinable period of time 70, it is also possible for second predefinable current level 72 to be read out. A variable N_IDIAGMAX is set at value N_IMIN, a variable N_IDIAGMIN is set at value N_IMAX, and a variable L_IF is set at value FALSE. Step 206 then follows.

In step 206, trigger signal 30 transmitted by diagnostic unit 28 to switching device 24 is set from the value "off" to the value "on." Step 208 then follows. Step 208 checks whether a termination condition for the diagnostic method is met. This termination condition may be given, for example, by the fact that the present time occurs after the end of predefinable period of time 70, that the present point in time occurs after the predefinable point in time 52 or that, for example, the duration of the present diagnostic method is greater than a maximum duration of a diagnosis. If this termination condition is met, the sequence branches off to step 210. If it is not met, the sequence branches further to step 220.

In step 220, a variable N_IAKT is set at the value of smoothed current signal 34 presently ascertained. Step 222 then follows. Step 222 checks whether present point in time t occurs before predefinable point in time 52. If so, step 224 follows. If not, step 225 follows.

Step 224 checks whether the value of variable N_IAKT is lower than the value of predefinable current level 50. If this is the case, the sequence branches further to step 226. If this is not the case, step 225 follows.

In step 226, variable L_IF is set at value TRUE. Step 225 then follows.

Step 225 checks whether present point in time t is within predefinable period of time 70. Alternatively, it may check whether the value of variable N_IAKT is lower than second predefinable current level 72. If this is the case, step 228 then follows. If this is not the case, the sequence branches back to step 208.

At point 228, there is a check as to whether the value of variable N_IAKT is lower than the value of variable N_IMAX. If this is the case, the sequence branches off to step 230. If this is not the case, the sequence jumps back to step 232.

In step 230, variable N_IDIAGMIN is set at the value of variable N_IAKT. Step 232 then follows.

In step 232, there is a check as to whether the value of variable N_IAKT is greater than the value of variable N_IMIN. If this is the case, step 234 follows. If this is not the case, the sequence jumps back to step 208.

In step 234, the value of variable N_IDIAGMAX is set at the value of variable N_IAKT. Next the sequence jumps back to step 208.

In step 210, there is a check as to whether the value of variable L_IF assumes value FALSE. If this is the case, step 212 follows. If this is not the case, step 214 follows.

Step 212 next diagnoses that the rotor of the engine fan is sluggish, i.e., defective. There follows, for example, an input of a defect flag in a defect register of the control unit or a visual or acoustic warning to the driver.

In step 214, there is a check as to whether the absolute value of the difference of two variables N_IDIAGMAX and N_IDIAGMIN is greater than predefinable ripple value 84. If this is the case, step 216 follows. If this is not the case, step 218 follows.

In step 216, it is now diagnosed that the fan has a damaged rotor, i.e., it is defective. There follows, for example, an input into a defect register of the control unit or an acoustic or visual warning to the driver.

In step 218, there is a check as to whether the check in each of step 210 and step 214 has yielded "no" in each case. If this is the case, the sequence branches off to step 220. If this is not the case, an input is made into the control unit indicating that the diagnostic method has been performed and that the fan has been diagnosed as defective and the sequence branches off to step 200.

In step 220, the engine fan is diagnosed as defect-free. There follows, for example, an input into the control unit, indicating that the diagnostic method has been performed and that the fan has been diagnosed as being defect-free. Next the sequence branches to step 200.

What is claimed is:

1. A method for diagnosing a fan, comprising:

ascertaining a current driving the fan;

triggering the fan by a defined trigger signal; and while the fan is arranged in a cooling circuit of an internal combustion engine, diagnosing, as a function of the ascertained current, whether the fan is defective;

wherein a first defect is diagnosed as a function of a ripple in a value derived from the ascertained current.

2. The method according to claim 1, wherein the defined trigger signal corresponds to a maximum trigger signal of the fan.

3. The method according to claim 1, wherein the defined trigger signal is constant.

4. The method according to claim 1, wherein a second defect is diagnosed when a value derived from the ascertained current does not fall below a predefinable current level up to a predefinable point in time.

5. The method according to claim 1, wherein the first defect is diagnosed when the ripple exceeds a predefinable ripple value within a predefinable period of time.

6. The method according to claim 1, wherein the ripple is characterized by an oscillation amplitude of the value derived from the ascertained current.

7. A non-transitory computer-readable storage medium with an executable program stored thereon, wherein the program instructs a microprocessor to perform the method recited in claim 1.

8. The method according to claim 1, further comprising:

obtaining a sliding average of the ascertained current, wherein the diagnosing includes determining whether the sliding average is below a predefined current level.

9. The method according to claim 8, wherein a second defect is diagnosed if the determination is that the sliding average is not below the predefined current level.

10. A method for diagnosing a fan, comprising:

ascertaining a current driving the fan;

triggering the fan by a defined trigger signal; and while the fan is arranged in a cooling circuit of an internal combustion engine, diagnosing, as a function of the ascertained current, whether the fan is defective;

wherein a first defect is diagnosed when a value derived from the ascertained current does not fall below a predefinable current level.

11. The method according to claim 10, wherein the value derived from the ascertained current is a value of the ascertained current itself.

12. The method according to claim 10, wherein the value derived from the ascertained current is a smoothed value of the ascertained current.

13. The method according to claim 12, wherein a second defect is diagnosed when the ripple exceeds a predefinable ripple value.

14. The method according to claim 13, wherein the second defect is diagnosed when the ripple exceeds the predefinable ripple value after the detected current signal has fallen below a second predefinable current level.

15. The method of claim 10, wherein the predefinable current level is selected as a function of a characteristic of the fan.

16. A device for diagnosing a fan, comprising:

a first device adapted to ascertain a current driving the fan;

a second device adapted to trigger the fan using a defined trigger signal; and a diagnostic unit adapted to diagnose whether the fan is defective based on the ascertained current, wherein the diagnostic unit is communicatively coupled to an electrical arrangement including the fan while the fan is arranged in a cooling circuit of an internal combustion engine;

wherein a first defect is diagnosed as a function of a ripple in a value, the value being derived from the ascertained current.

17. The device according to claim 16, wherein the ripple is characterized by an oscillation amplitude of the value derived from the ascertained current.

* * * * *